United States Patent [19]

Lansing

[11] Patent Number: 4,910,816

[45] Date of Patent: Mar. 27, 1990

[54] ADJUSTABLE BED TABLE

[75] Inventor: James P. Lansing, St. Cloud, Minn.

[73] Assignee: JVJ Enterprises, Inc., St. Cloud, Minn.

[21] Appl. No.: 200,765

[22] Filed: May 31, 1988

[51] Int. Cl.[4] ..... A61G 7/02

[52] U.S. Cl. ..... 5/90; 5/72; 5/80

[58] Field of Search ..... 5/90, 66–69, 5/72, 80

[56] References Cited

U.S. PATENT DOCUMENTS

| | | | |
|---|---|---|---|
| 1,560,422 | 11/1925 | Hendrix . | |
| 2,204,343 | 6/1940 | Dawson | 4/134 |
| 2,500,544 | 3/1950 | Haskins | 5/90 |
| 2,500,741 | 3/1950 | Taylor | 5/90 |
| 2,500,743 | 3/1950 | Beem et al. | 5/90 |
| 2,788,529 | 4/1957 | Moritzacky et al. | 5/72 |
| 2,899,694 | 8/1959 | Horowitz | 5/90 |
| 3,050,741 | 8/1962 | Coleman | 4/134 |
| 3,503,083 | 3/1970 | Barnett | 5/90 |
| 4,085,472 | 4/1978 | DiMatteo | 5/90 |
| 4,190,913 | 3/1980 | DiMatteo et al. | 5/81 |
| 4,282,613 | 8/1981 | Violante | 5/90 |

FOREIGN PATENT DOCUMENTS

| | | |
|---|---|---|
| 1303238 | 9/1971 | United Kingdom . |
| 1416698 | 11/1972 | United Kingdom . |
| 1569807 | 1/1977 | United Kingdom . |
| 2125284 | 8/1982 | United Kingdom . |
| 0068668 | 5/1983 | United Kingdom . |
| 2171898 | 2/1985 | United Kingdom . |
| 2200544 | 2/1987 | United Kingdom . |

*Primary Examiner*—Alexander Grosz

*Attorney, Agent, or Firm*—Fitch, Even, Tabin & Flannery

[57] ABSTRACT

A bed table with a vehicular mounting provides adjustable support for a person in a number of different postures, including a reclined table-like configuration and an erect chair-like configuration. The bed table is segmented into three portions, a head support portion, a medial or central support portion, and a leg support portion. The head support portion and leg support portion are pivotally mounted to a support base and are interconnected with linkage such that the leg support portion follows the rotational displacement of the head support portion. A pneumatic or hydraulic actuator is attached to the head support portion and is controlled through a control panel for automatic operation of the bed table, between the reclined table-like and erect chair-like configurations. An energy source for the actuator is provided by a vessel containing compressed nitrogen. The bed table is provided with a bedpan, swingably mounted into and out of engagement with the central support portion. When mounted against the central support portion, the bedpan is aligned with an aperture extending to the upper surface of the bed table.

18 Claims, 6 Drawing Sheets

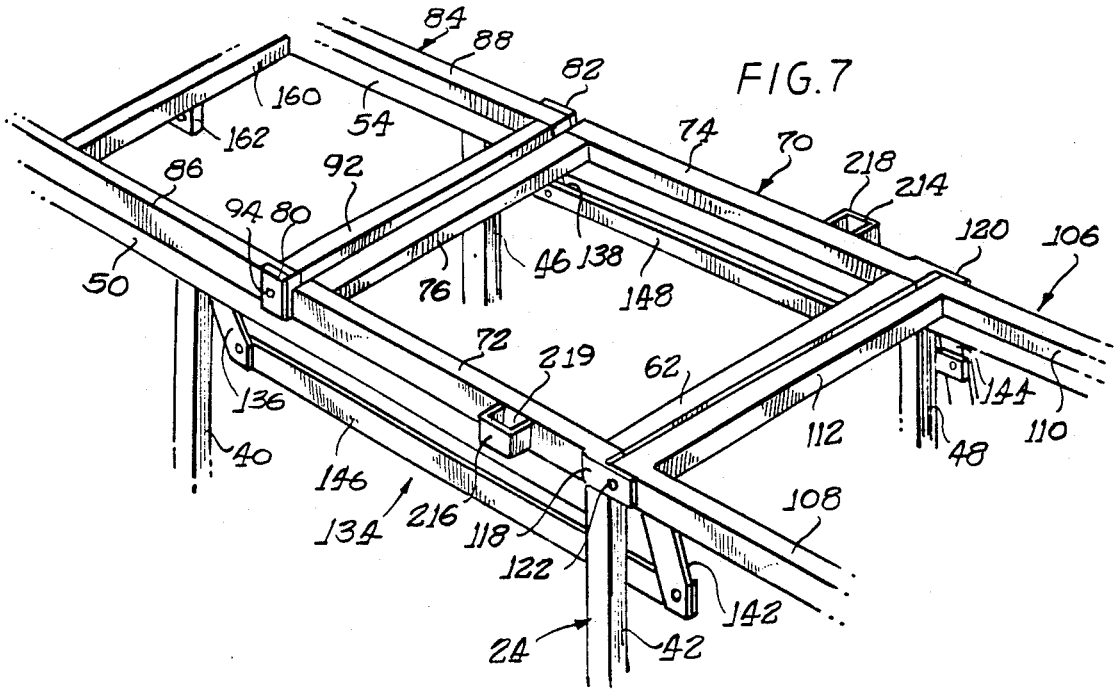
FIG. 7
FIG. 8
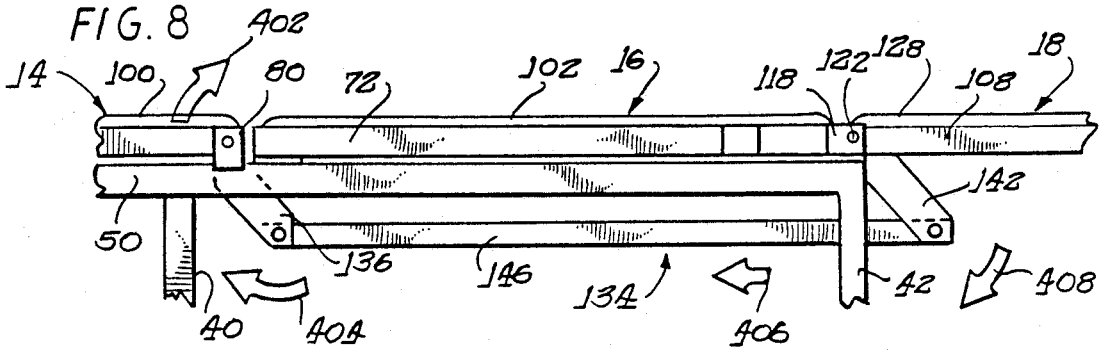
FIG. 9
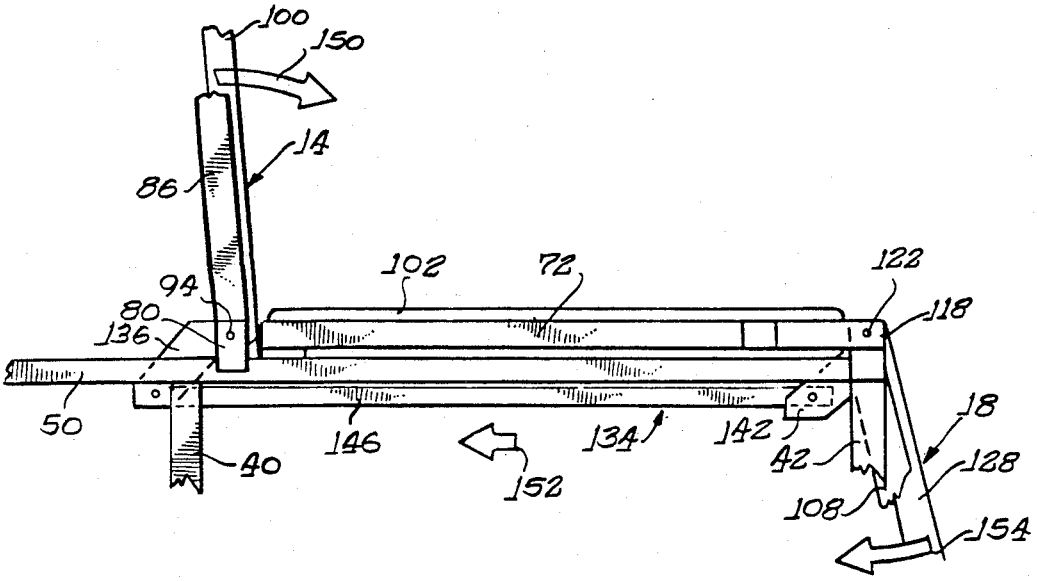

ADJUSTABLE BED TABLE

BACKGROUND OF THE INVENTION

1. Field of the Invention

The present invention pertains to a bed table comprised of movably interconnected sections which can be reconfigured as a chair. More particularly, the present invention pertains such tables having bedpan facilities.

2. Description of the Prior Art

Mobile bedside tables have been provided with a height suitable for coplanar alignment with a patient's bed so as to facilitate the patient's ability to slide onto the table. When provided with vehicular mounting, such tables can be used by an attendant to easily transport a patient from one location.

For patients who are unable to use remotely-located bathroom facilities, bed tables have been provided with commode or bedpan facilities. The tables may have one or more foldable sections to approximate roughly the configuration of a chaise lounge. Examples of these types of bed tables are given in U.S. Pat Nos. 1,560,422; 2,500,544; and 2,899,694. U.S. Pat. No. 3,050,741, for example, has multiple sections, foldable into a chair-like configuration.

Each of the above U.S. patents has vehicular mounting to provide patient transport from one location to another. When located in a hospital, for example, the vehicular mounting allows the bed table to be moved between patients' rooms, upon demand. This offers an improvement over the stationary convertible bed of U.S. Pat. No. 4,282,613, for example. Also, the bed tables with vehicular mounting need not be integrated into a particular bed structure, as in U.S. Pat. Nos. 2,500,741; 2,500,743; 3,503,083; 4,190,913; and 4,085,472, all of which are built into a patient's bed structure for dedicated use therewith.

It is important, especially when a bed table vehicle with bedpan facilities is shared among different patients, that the bedpan be quickly and easily removed for service at a remote location. Accordingly, there is a need for a simple and efficient system for moving the bedpan into and out of position. U.S. Pat. No. 2,204,343, for example, discloses a relatively massive mechanism operated by a hand crank, for raising and lowering a bedpan into and out of position.

Although the above bed tables with bedpan facilities have been provided in a variety of different styles and arrangements, improvements are still being sought and there is a strong demand for bed tables having most or all of the following features. For example, many of the convertible bed tables have hand cranks for raising a back support portion of the table or for reconfiguring the table into a chair. While it may be a relatively simple matter to operate the crank on an empty bed table, considerable physical effort is required when a bed table is converted into a different configuration with a patient lying on the table. This is, however, one o the attractive features of a bed table convertible into a chair or the like.

While this problem is alleviated by employing electric motors as the energy source for raising and lowering a patient on a convertible bed table, motorized arrangements suffer from a number of deficiencies. First, the bed table must be located at or near a supply of electrical current which might not be readily available at all locations of use. For example, when a bed table is employed in a domestic setting where the patient's sickroom may not have a electrical outlet immediately adjacent the desired location for the patient's bed. Further difficulties are encountered with beds having electric motors which are employed to raise and lower a patient. Depending on their physical condition, some patients find maintaining an erect body posture very exhausting even for relatively short periods of time. If a power failure should occur while the table is in an upright position, the patient may be made to experience a considerable amount of discomfort, particularly when being transported back into a bed. Further, even if hand cranks are available in such emergency conditions, an operator of the bed table, particularly in a domestic setting, might not be familiar with the crank and locking systems for the particular bed, and may not be familiar with mechanisms of that type in general. For larger patients, a considerable moment is applied to the mechanism particularly as the back support portion of the table is inclined at successively lower positions. As has been observed, older and informed patients might become alarmed at even the slightest sense of an uncontrolled condition in the apparatus supporting their body. It is, therefore, desirable that a bed table, particularly one with a vehicular mounting be completely self contained with its own separate uninterruptable energy source.

Frequently, a patient will be treated with oxygen, or other inflammable materials might be located proximate the patient's bed. The bed table should be safe for use in these and other hazardous environments.

It is desirable that bed tables having bedpan facilities, and particularly such bed tables shared with a number of different patients, be suitable for frequent steam cleaning and not have components such as greased mechanisms or electrical motors which are susceptible to damage when steam cleaned.

In providing convertible bed tables suitable for use with bedpan facilities, it is generally desirable that a patient be provided with an erect sitting posture. Accordingly, it is important that the bed table have foot and leg support as well as back support sections which are movable to approximate a chair-like position as closely as possible. It is also desirable that a bed table of this type be configurable to intermediate positions for patients who, for one reason or another, cannot be moved to completely erect positions.

It has been found that patients who can move themselves onto a bed table prefer to do so, even if such requires a great effort, rather than requiring an attendant's help. Such patients, it has been found, also prefer a bed table which will automatically change configurations into a chair-like position. It is desirable to provide these patients with an automatic system subject to their own control, for configuring the apparatus between chair-like and table-like configurations.

SUMMARY OF THE INVENTION

It is therefore an object of the present invention to provide an automatically operated bed table, having a self-contained energy source.

Another object of the present invention is to provide a self-contained bed table which does not require connection to external supply lines, such as an electrical outlet.

A further object of the present invention is to provide a bed table which is automatically convertible from a table configuration, and which can optionally be operated by a patient supported by the bed table.

Yet another object of the present invention is to provide a bed table having automatic operation, which is safe for use in an oxygen atmosphere or other hazardous environment.

Still another object of the present invention is to provide a bed table of the above-described type which is not deteriorated or otherwise impaired by steam cleaning or the like.

Another object of the present invention is to provide a bed table having fail-safe operation, with stored energy means for the controlled conversion of the apparatus to a bed table configuration.

A further object of the present invention is to provide a bedpan for use with a bed table having a mounting for swinging the bedpan into view during loading and unloading from the bed table.

A further object of the present invention is to provide a three-section bed table having head, intermediate and foot portions, in which the head and the foot portions move together in a predetermined relationship.

These and other objects of the present invention are provided in a vehicular mounted bed table apparatus for adjustably supporting a person in a number of different postures. The bed table has a segmented table top including a head support portion, a double-ended medial support portion for supporting a person's mid-section, and a leg support portion. The table top is supported by a vehicular frame, and means are provided for mounting at least the medial support to the frame. The head support portion can be pivotably connected to one end of the medial support, and the leg support portion can be pivotably connected to the other end of the medial portion. Pressure-responsive, fluidically operated displacement means are connected to the head support portion for pivotable displacement of that portion with respect to the medial support portion, to allow raising and lowering of the upper portion of a person reclining on the bed table. Pressure means are provided for imparting fluidic pressure to the fluidically operated displacement means.

Other objects of the present invention are provided in a bed table of the above-described type having a bed pan swingably mounted to tee medial port portion thereof. The swingable mounting for the bedpan can be provided by pivotally interconnecting linkage supporting the bedpan at three or more spaced-apart points along its outer periphery, swingably displacing the multiple peripheral points of the bedpan simultaneously.

BRIEF DESCRIPTION OF THE DRAWINGS

In the drawings, wherein like elements are referenced alike,

FIG. 7 is a fragmentary perspective view of the of the adjustable bed table;

FIGS. 8 and 9 are fragmentary side elevational view of the framework portion of FIG. 7 shown in table-like and chair-like configurations, respectively;

DETAILED DESCRIPTION OF THE PREFERRED EMBODIMENT

Figure 1:
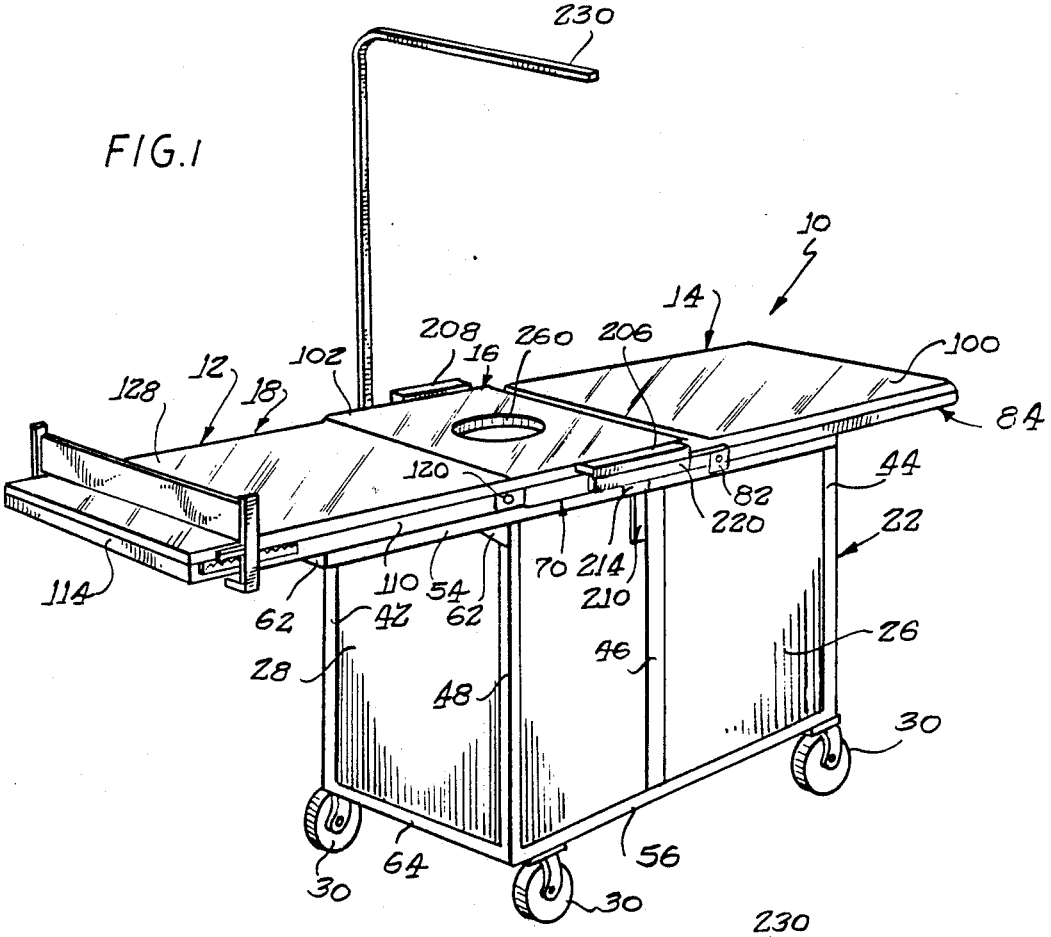
FIG. 1 is a perspective view of an adjustable bed table illustrating features of the present invention, shown in a first flat, table-like configuration.
Figure 16:
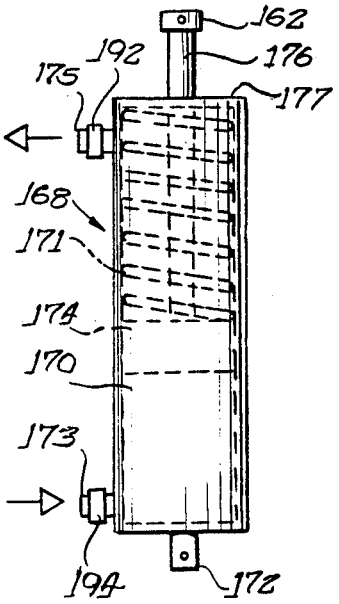
FIG. 16 shows the fluidically-operated pressure cylinder of the preceding figures, in greater detail.
Figure 2:
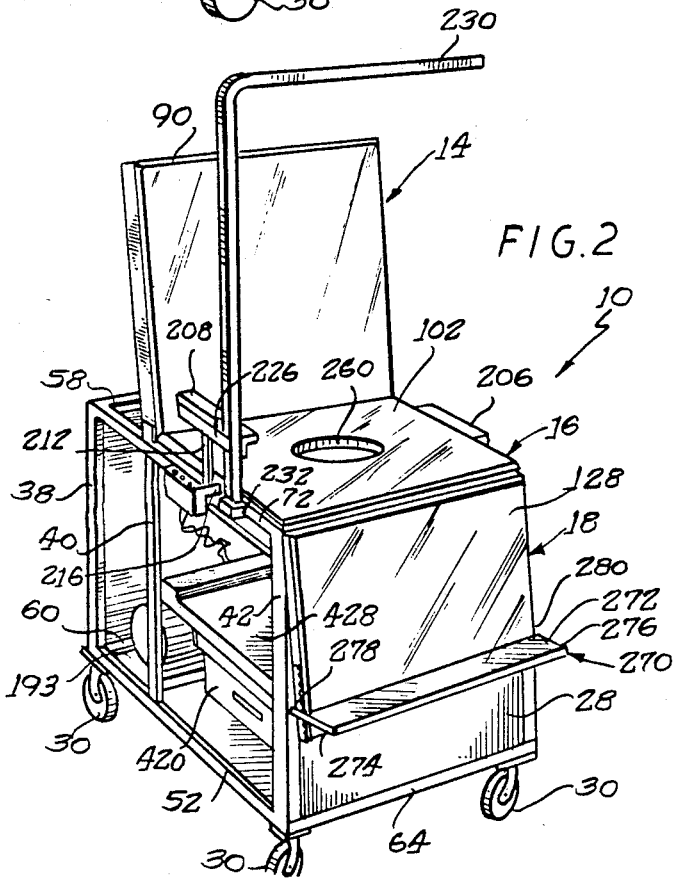
FIG. 2 is a perspective view of the adjustable bed table of FIG. 1 shown reconfigured to a chair-like position.

Referring now to the drawings, and especially to FIGS. 1–4, an adjustable bed table according to features of the present invention is illustrated generally at 10. The bed table 10 includes an upper table top or support surface 12 for supporting a patient in a prone or prostrate position. According to one aspect of the present invention the support surface 12 is segmented into three tabletop sections or support portions including a head support portion 14, a central or medial support portion 16, and a leg support portion 18. The three support portions 14–18, as will be seen in greater detail, are pivotally interconnected so as to be movable between a first table-like configuration as illustrated in FIG. 1 and a second chair-like configuration as illustrated in FIG. 2. In the preferred embodiment the three support portions each include a lower rigid support base covered with a suitable chemical resistant fabric such as a Teflon or a Teflon coated glass fabric. The three support portions are preferably padded with a material suitable to withstand the rigors of repetitive steam cleaning and the like. An example of the preferred construction will be described herein with reference to FIG. 15. According to one aspect of the present invention, the entire adjustable bed table, including the moving parts and particularly the automatic fluidically operated power system are all suitable for frequent steam cleaning.

The three support portions, 14–18 are mounted on a vehicular-support base generally indicated as 22. Base 22 of the preferred embodiment is formed of an open framework 24 of tubular stainless steel, and includes wall panels 26, 28 as well as other components which will be described herein. The framework of the bed table is preferably formed of tubular stainless steel which is welded at its various joints. Other suitable materials may also be used. However, it is preferred that all materials utilized in the bed table, including the framework members, be chemically resistant and be suitable for repetitive steam cleaning and other cleaning procedures necessary to maintain the bed table and its components in a hygienic condition.

Caster rollers 30 provide a vehicular mounting for the bed table allowing a patient to be carried thereon for convenient transport from one location to another. A floor lock 32 is one of the means provided herein for securing the table against movement, especially when the patient is being transferred between the bed table and a conventional bed. Preferably, the floor lock consists of a housing 34 in which is mounted a movable foot 36 which is both flexible and floating so as to compensate for irregular floors. The foot is spring loaded and is selectively engageable and releasable by operating a foot pedal 38.

Figure 3:
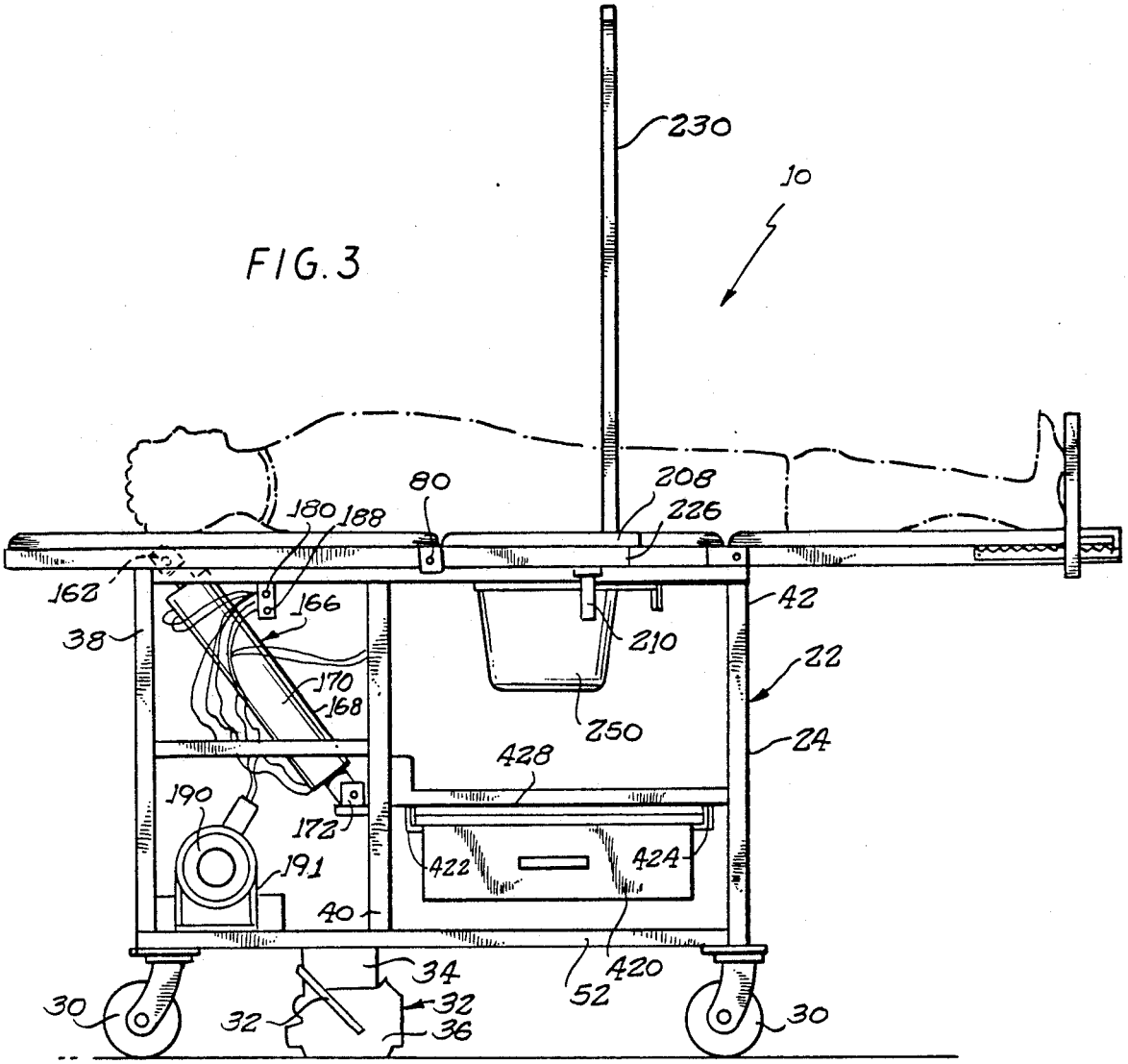
FIG. 3 a side elevational view of the adjustable bed table of the preceding figures.
Figure 5:
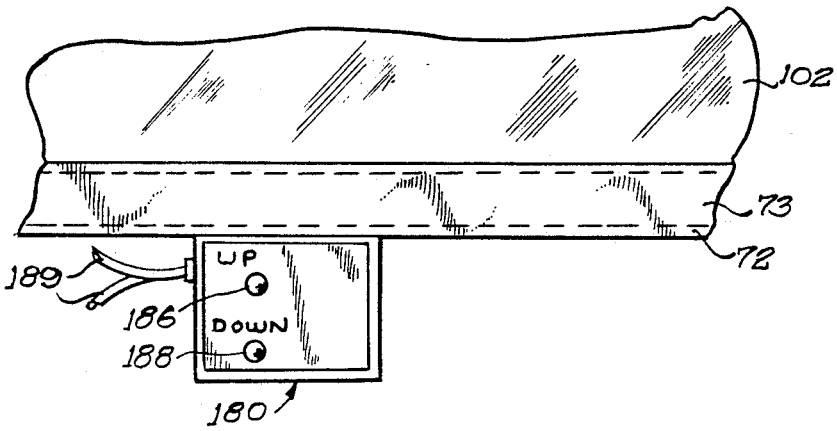
FIG. 5 is a fragmentary elevational view showing the control panel portion of the adjustable bed table in greater detail.
Figure 4:
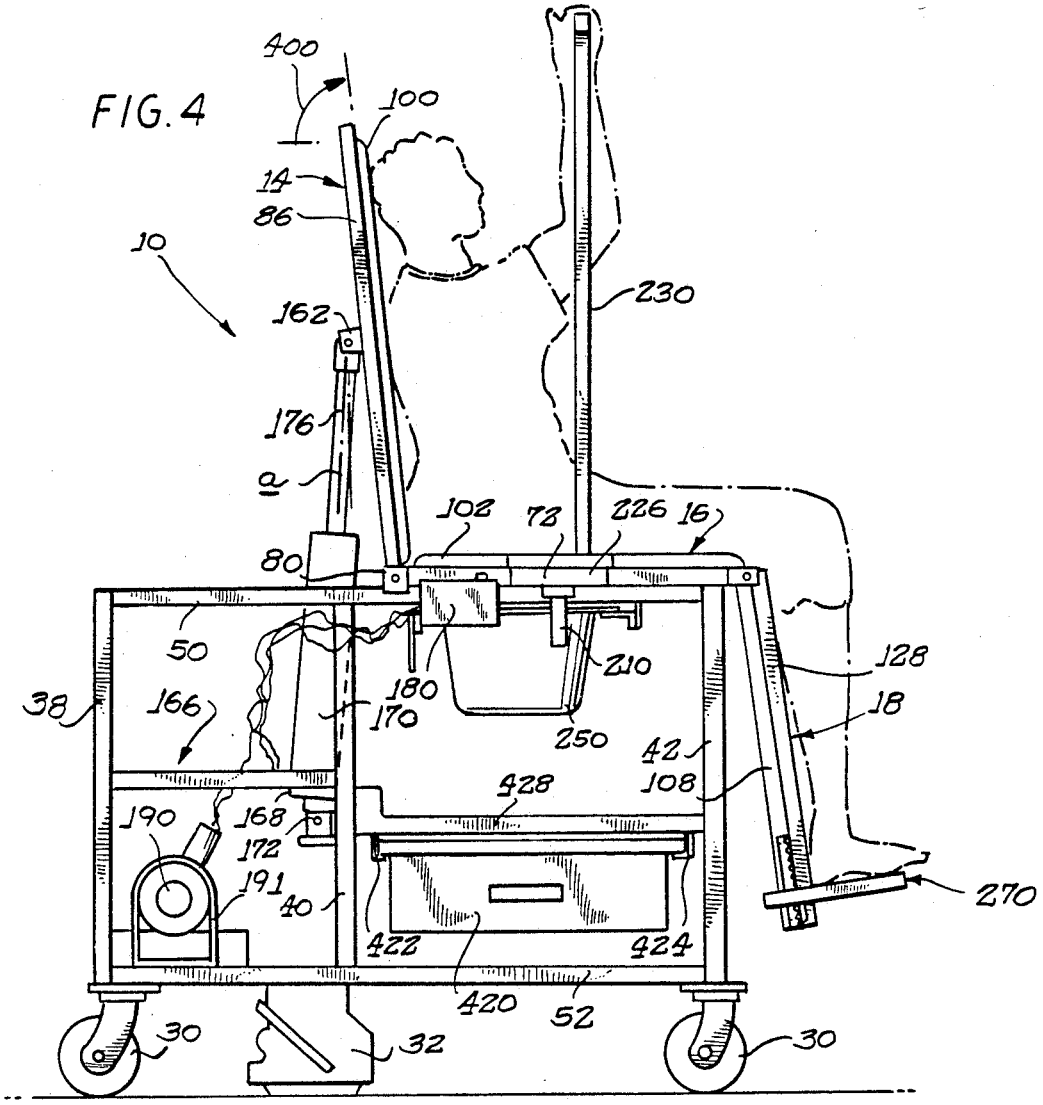
FIG 4 is a side elevational view of the adjustable bed table configured to assume a chair-like position.
Figure 6:
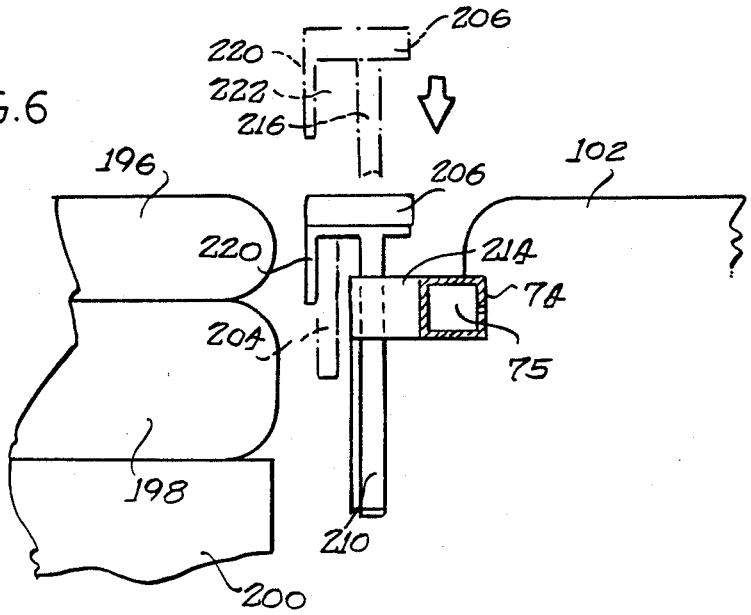
FIG. 6 is a fragmentary elevational view showing the adjustable bed table clamped to a side of a patient's bed.

FIGS. 3 and 4 illustrate the bed table from a frontal position while FIG. 1 illustrates the bed table from a rearward position. The base 22 is configured to have a suitable height such that the upper surfaces of the support portions 14–18 are generally at the same level as the upper surface of the patient's bed, thereby forming a coplanar extension thereof. After rolling the bed table 10 into a patient's room, the bed table is positioned such that one side (herein the rear side) of the bed table is positioned abutting the patient's bedside, as illustrated in FIG. 6. The bed table illustrated in FIG. 1 is configured for access to the right hand side of the patient's bed with the panel 26, for example, being located adjacent the patient's bedside and with the head portion 14 located adjacent the patient's head and the leg portion 18 adjacent the patient's legs. As will be appreciated, the bed table is conveniently convertible to access the other, left hand side of the patient's bed if desired.

Referring briefly to FIG. 7, the support portions 14–18 have been removed to clearly illustrate the framework 24. The panels, 26 and 28, have also been removed to aid in the clarity of the illustration. FIG. 7 is oriented such that the frontal side portion of the bed table is in the foreground while the rear side portion of the bed table is shown in the background of the figure. Thus, when installed, the panel 26 (visible in FIG. 1) would be at the rear of the table, appearing in the background portion of FIG. 7.

With additional reference to FIGS. 3 and 4, the base 22 includes vertical support members 38, 40, and 42 at the front side of the bed table adjacent the had, central, and leg supporting sections thereof, respectively. Vertical supports 44, 46, and 48 oppose the vertical supports 38, 40, and 42, respectively, being located at the rearward portion of the bed table, that side in contact with the patient's bed. Upper and lower frontal side support members 50, 52 extend the length of vehicular base 22 and are located at the forward end thereof. Similarly, rearward side support members 54, 56 are located at the rearward end of the bed table. Upper and lower transverse support members 58, 60 span the front and back sides of the support base and are located adjacent the head support portion of the table. Similar transverse support members 62, 64 are located adjacent the foot support portion of the table. As thus far described, an open, tubular framework has been provided defining a three-dimensional structure having rectangular sides. Vehicular mounting is provided by caster rollers 30 which are attached to the lower support members 52, 56 at the lower corners of the rectangular framework.

Figure 10:
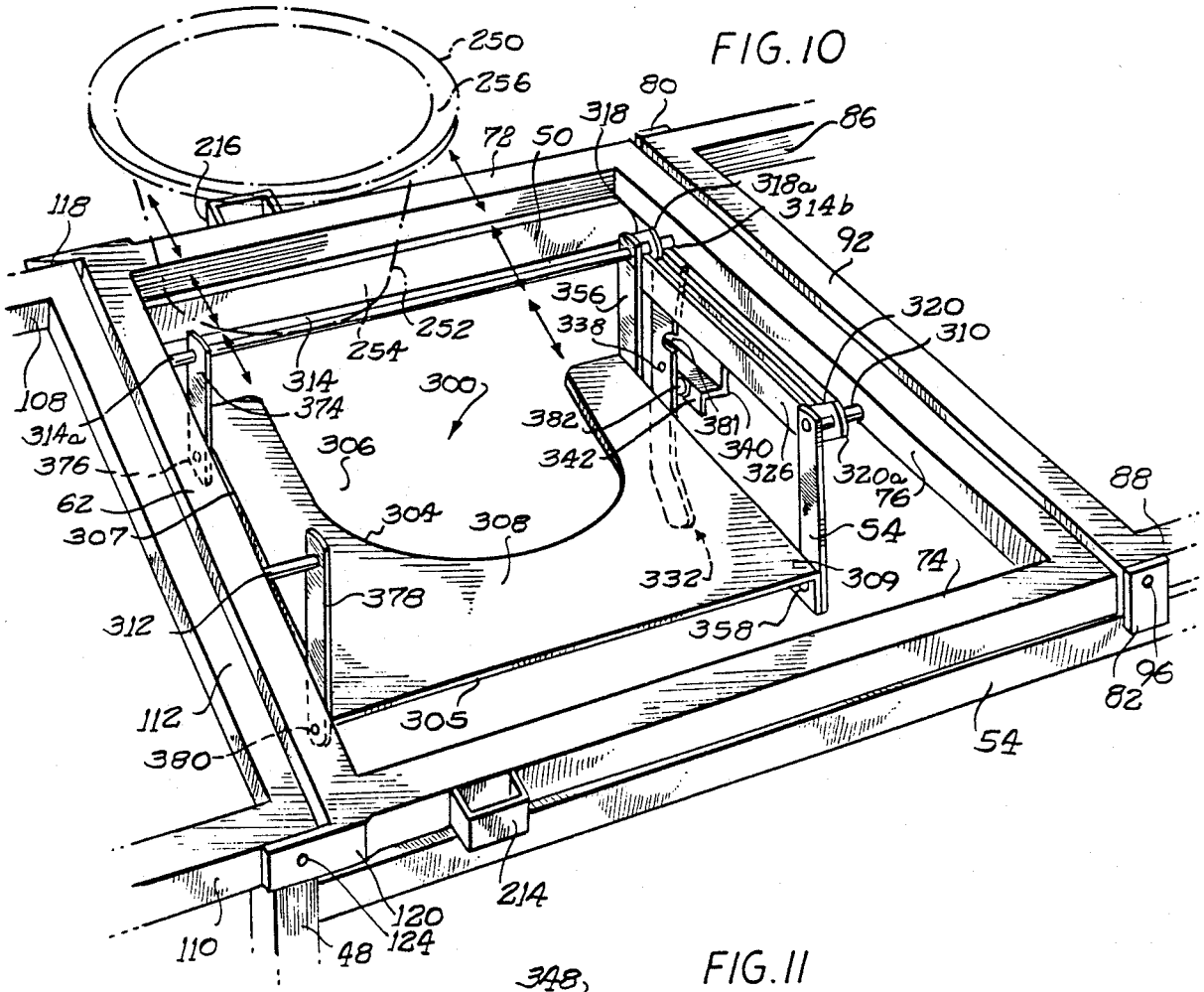
FIG. 10 is a perspective view of an apparatus for mounting the bedpan to an adjustable bed table.

Referring to FIGS. 7 and 10, a rectangular frame generally indicated as 70 is located at the central portion of the bed table and forms an immovable part thereof. Frame 70 includes front and rear side frame members 72, 74 joined at first ends by a transverse frame member 76 located adjacent the head portion of the table and the aforementioned transverse member 62 joining the opposite ends of members 72, 74, adjacent the leg support portion of the table. The members 72, 74 of rectangular frame 70 are welded to the upper side support members 50, 54.

Referring again to FIGS. 7 and 10, upwardly extending hinge plates 80, 82 are secured to the upper support members 50, 54 adjacent the transverse member 76. A rectangular frame-like carrier generally indicated as 84 rests on top of the upper support members 50, 54 having a first free end adjacent the head support portion o the table and a second pivotally mounted end adjacent the central frame 70. The carrier 84 includes side support members 86, 88, an upper transverse member 90 (See FIG. 2) and a lower transverse support member 92. Carrier 84 is pivotally mounted at its lower end by pivot pins 94, 96 attached to hinge plates 80, 82, respectively. Referring briefly to FIG. 9, the head support portion 14 in addition to the frame-like carrier 84 includes a panel 100 of the type described above comprising a rigid backing plate padded with a suitable padding material and covered with a chemical resistant fabric such as teflon. The padded (panel 100 is attached to frame 84 in any suitable manner, but is preferably press fit within the pivotally mounted frame, in the manner illustrated in FIG. 156 A similar construction is illustrated in the cross-sectional view of FIG. 15. Preferably, all three support portions 14–18 have this same construction.

The central support portion 16 of the bed table includes the rectangular framework 70 described above and a padded panel 102 of construction similar to that of the padded panel 100. Panel 102 is preferably press fit within the frame 70.

Figure 15:
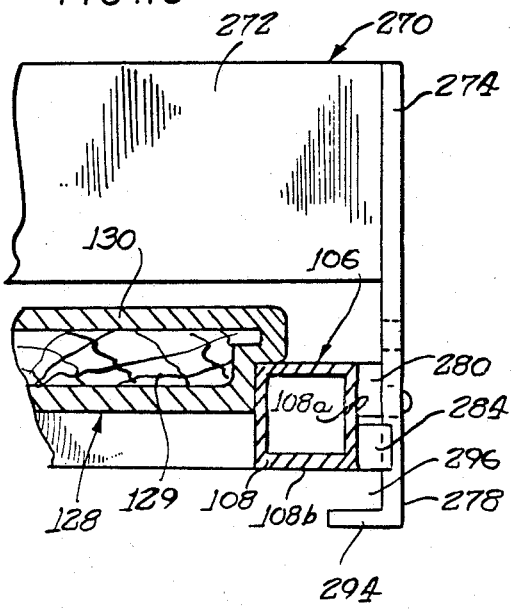
FIG. 15 is a fragmentary elevational view of the foot support portion of FIG. 13 taken along the line 15—15 thereof.

The third leg support section 18 of the bed table includes a pivotally mounted rectangular framework 106 including side members 108, 110, an upper transverse support member 112 and a lower transverse member 114 (See FIG. 1). A pair of hinge plates 118, 120 extend horizontally from the side support members 72, 74 of the central frame 70. The framework 106 is pivotally mounted at one end to hinge plates 118, 12 by a pair of coaxially aligned hinge pins 122, 124. The leg support section 18 is completed with the insertion of a padded panel 128 therewithin. As mentioned above, the panels 100, 102 and 128 are similarly constructed. Referring to FIG. 15, panel 128 has a rigid plate-like core 129, which is padded at 130 with a suitable padding and outer fabric covering. Panel 128 has peripheral edges 131 suitable for press-fit retention in the surrounding rigid framework.

Referring now to FIGS. 7–9, the head and leg support portions 14, 18 are interconnected by linkage generally indicated as 134. Hinge plates 136, 138 are welded to the bottom portion of the frame-like carrier 84, adjacent the transverse member 22 thereof. Hinge plates 142, 144 are welded to the framework 106 of the leg support portion 18. A rear link arm 146 pivotally interconnects the hinge plates 136, 142 at the frontal side of the bed table. Similarly, a rear link arm 148 pivotally interconnects hinge plates 138, 144 being pinned at each end to a respective hinge plate. With reference to FIG. 9, as the head support portion 14 is elevated in the direction of arrow 150, the hinge plates 136 and 138 ar rotated about the axis of pivot pins 94, 96. Preferably, the pivot pins 94, 96 are coaxially aligned with one another. This displacement of the hinge plates causes the link arms 146, 148 to be translated in the direction of arrow 152 (See FIG. 9). This in turn causes a pivotal displacement of the hinge plates 142, 144 causing the foot support portion to pivot about its hinge pins 122, 124 in the direction of arrow 154. Thus, by comparing FIGS. 8 and 9, it can be seen that, as the head support portion 14 is elevated, the leg support portion 18 is lowered, thereby reconfiguring the bed table from the table-like configuration in FIG. 1 to the chair-like configuration of FIG. 2.

With reference to the weight distribution along the three portions 14–18 of the bed table, the leg support portion 18 bears the least amount f the patient's weight. According to one aspect of the present invention, lifting support is applied to the head support portion 14 with a pivotally interconnecting linkage 134 causing the leg support portion 18 to follow the motion of the head support portion 14.

In a reclined table-like configuration, the three support portions 14–18 are aligned coplanar, with the frame-like carrier 84 of the head support portion 14 contacting the one support of the upper side support members 50, 54 of the support base. As mentioned above, the central frame 70 is immovably mounted by welding to the support base 22 and has its upper and lower ends proximally located to pairs of upright supports 40, 46 and 42, 48, respectively.

The leg support portion, that loaded the least amount, is supported adjacent its pivotally connected end through the interconnecting linkage 134. The weight borne by the leg support framework 106 applies a compressive loading to the link arms 146, 148 in the general direction of arrow 152 (See FIG. 9). This amount of support for the leg portion 18 has been found to be thoroughly satisfactory. If desired however, one or two struts can be located adjacent the free arms of the leg support portion 18 and the lower portion of the framework 24 preferably adjacent the lower transverse support member 64.

Such optional struts are generally not preferred as a completely automatic operation of the preferred table may be hindered. One feature of the preferred embodiment of the present invention is that the bed table is automatically operable between its table-like and chair-like configurations and, according to one aspect of the present invention, the controls may be provided within reach of a patient supported by the bed table who can, without requiring the presence of an attendant, operate the bed table between its two configurations.

Referring to FIG. 7, the frame-like carrier 84 includes an intermediate transverse member 160 welded at each end to the side support members 86, 88 of the carrier. A bracket 162 is welded to a medial portion of the transverse member, preferably at the center thereof, to provide a pivotal connection for a fluidically operated actuator system which, under the control of the patient or an attendant, configures the bed table between its table-like and chair-like configurations without requiring physical exertion of the person operating the actuator controls. Referring now to FIGS. 2–5 and 16, the actuator system is generally indicated as 166 and includes a pressure-operated cylinder 168 of either the hydraulic (liquid pressure fluid) or pneumatic (gaseous pressure fluid) type. The cylinder includes an outer housing 170 having a pivotal connection at its lower end to a bracket 172. Cylinder 168 includes an internal piston 174 connected to a piston rod 176. The piston rod in turn is pivotally connected to bracket 162. The pressure cylinder 168 preferably comprises a double-action cylinder, with ports 173, 75 (see FIG. 16) at each end. The cylinder may be operated in either a single-action or a double-action mode, and the pressure fluid for its operation may be either a liquid or a gas. If operated in a single-action mode, an internal spring 171 is provided, for reasons to be detailed herein. The port 173 at the bottom of the cylinder provides pressure injection and release during raising and lowering. If operated as a double-acting cylinder, an upper port 175 provides an additional site of pressure injection, for retracting the bed table to a reclined, table-like configuration.

With the bed table in the reclined position, piston rod 176 is withdrawn into housing 170 to assume a first, retracted position. Upon demand, the cylinder 168 is pressurized so as to displace its internal piston 174, thereby extending the piston rod 176. The pivotal connection of the lower end of cylinder 168 to bracket 172 remains stationary while allowing the hydraulic cylinder to pivot about its lower end, between the retracted and extended positions shown in FIGS. 3 and 4, respectively. Upon command, the pressure-operated cylinder 168 can be programmed to automatically retract from the extended position of FIG. 4 so as to draw the piston rod 176 into the housing 170. This retraction causes the head support portion 14 to pivot about its hinged mounting 80, 82 until it contacts the upper side supports 50, 54. If desired, a stop can be provided to define the lower end point of travel of the head support portion 14. For example, a stop member can be provided to engage the upper part of the cylinder housing 170 when the housing is in the position shown in FIG. 3. However, due to the relatively large surfaces of the side support members 50, 54 of the framework 24 and of the side support members 86, 88 of frame-like carrier 84, no such auxiliary stop has been found to be necessary.

By arresting any further downward deflection of the head support portion 14, the leg support portion 18 pivotally interconnected therewith is fixed in position. Preferably, the hinge connections 80, 82 of the head support portion extend from the central frame 70 which is conveniently made from the same size tubing as the upper side support members 50, 54. With a frame-like carrier 84 of similar cross-sectional dimensions as the vehicular base framework, the desired alignment of the head support portion when in contact with the upper side supports 50, 54 is easily and economically attained. General coplanar alignment of the leg support portion 18 with the remaining support portions 14, 16 is easily attained by adjusting the length of the interconnecting link arms 146, 148.

As briefly mentioned above, the pressure cylinder 168 can be operated in a double-acting mode wherein a pressure fluid is applied to each end of the internal piston to raise and lower the head support portion. However, it is generally preferred to operate the pressure cylinder in a single-action mode wherein an internal spring, such as the spring 171, is disposed within the cylinder housing adjacent the upper end thereof. Upon the application of a pressurized fluid to the lower end of the housing, the work done by the piston 174 not only raises the head support portion 14 and lowers the interconnected foot support portion, but also compresses the internal spring 171, so as to store energy which will later be used when the bed table is returned to its reclined position. In the single-action mode, pressure is applied only to the lower end of cylinder 168, the upper port 175 of the cylinder being utilized to relieve vacuum upon retraction of the piston rod 176, and to relieve back pressure on the piston 174 during extension of the piston rod.

The inclusion of an internal spring augments the pressure imparted to the piston 174, due to the gravity force applied thereto through the pivot connection 162 between the upper end of the piston rod and the head support portion. As can be seen from FIG. 4, the head support portion 14 has a maximum displacement upon raising that stops short of a true vertical position, thereby ensuring a downward gravity component on the piston 174 when retraction thereof is initiated. If desired, the cylinder 168 need not be provided with an internal spring, the retraction of the single-acting piston being initiated solely by the weight of the patient's upper torso.

It is generally preferred that the retraction of the piston be regulated with a controlled release of the pressure in the bottom part of the cylinder generated by the retracting piston. A bleed control valve, for example, can be installed in housing 170 adjacent the bottom end thereof, or the port 173, now functioning as an exhaust port of the cylinder, can be routed to a control valve such as the control valve 180 mounted to the upper side support 50, which provides the controlled pressure release necessary for the desired retraction of the piston 174 within cylinder 168. As mentioned above, the cylinder can be operated in a dual action mode, wherein a pressurized fluid is also applied to the port 175 at the upper portion of the housing so as to positively drive the internal piston in a downward direction, thereby retracting piston rod 176.

It is generally preferred according to another aspect of the present invention that the retraction of the piston rod be accompanied by a controlled retraction force such as that provided either by a internal spring or by a double-action cylinder. It has been found that the patients' comfort and sense of security is greatly improved if the bed table provides a consistently smooth action, not only in its raising cycle, but especially in its lowering cycle, regardless of the orientation of the patient's weight relative to the head support portion. Accordingly, with the application of a return force augmented via an internal spring or double-action cylinder, a lowering of the head support portion is rendered more consistent from one cycle of operation to another.

According to another aspect of the present invention, the actuator system 166 and the controls therefor are completely devoid of electrical components such as current-carrying wires, electrical switches, and the like, so as to offer safe operation, even in hazardous areas. It is preferred that the control systems be operated by either hydraulic or pneumatic fluid. As can be seen in FIG. 3, for example, the control panel 180 controlling the extension and retraction of the piston rod 176 may be located outside of the patient's reach. However, in many cases, a patient prefers to control operation of the adjustable bed table for himself, without requiring an attendant to be present. For those patients who are capable of operating the controls and who desire to do so, the control panel 180 may be mounted to the upper side support 50 adjacent the patient's right hand, as illustrated in FIG. 4. The control 180 is illustrated in greater detail in FIG. 5. In general, the control panel 180 provides two buttons 186, 188 which are connected through hydraulic lines 189 to the top and bottom of hydraulic cylinder 168. The button 186, for example, can be used to initiate the pressurization of the bottom portion of the cylinder housing so as to drive the internal piston 174 from a lowered retracted position to an upper extended position, thereby initiating reconfiguration of the bed table to a chair-like upright position.

The second button 188, for example, can be used to initiate a release of pressure from the bottom of the cylinder housing and to vent tee upper portion of the housing, so as to allow an internal piston to retract thereby lowering the head support portion of the table and raising the leg support portion thereof. If desired, speed controls 192, 194 such as flow control valves or the like can be provided on cylinder 166 (see FIG. 16) to control the rate of raising and the rate of lowering the head support portions and leg support portions of the table. These speed controls 192, 194 are optional, but have been found to provide a greater sense of security and a greater sense of control for patients who choose to operate the bed table without the help of an attendant. The speed controls 192, 194 can, for example, comprise variable orifice valves or other controls for suitably adjusting either the pressure or the rate of flow of the pressure medium within the cylinder 168.

It can be seen from the above, that although pressure is required to elevate the head support portion when reconfiguring the bed table into a chair-like configuration, energy can conveniently be stored in the pressure cylinder when the bed table is raised to its upright position. Accordingly, even with a loss of a power source applied to the piston with the cylinder, energy is made available for the controlled lowering of the bed table to the reclined position. This represents a significant improvement over prior bed tables operated by an electrical motor, for example, which is vulnerable to an interruption of power to the operating mechanism. With prior devices, a patient, particularly an unattended patient could be made to experience considerable difficulty if they are unable to recline an erected bed table. Many patients, for example, can comfortably tolerate a sitting position for only a limited amount of time With the arrangement of the present invention, a patient is guaranteed the ability to turn the bed table to the reclined position.

The actuating system according to the present invention can be operated with a variety of pressure media, which are, preferably, fluids. For example, the cylinder could be operated with a liquid pressure medium pressured by an air-driven pump, or the cylinder could be energized directly by a pressurized gas source such as a compressed air source of type typically provided throughout a hospital. Such pressurized sources would of course have to be disconnected if the patient is to be transferred to a remote location utilizing the vehicular features of the bed table. While this might pose little difficulty in many hospital rooms, each of which have their own source of compressed air, the repetitive connection and disconnection from the power source can be inconvenient.

It is also possible that a particular location to which a patient is temporarily moved may not have a compressed air source available. While the present invention has found ready acceptance in a hospital environment, the bed table is also intended for use in a home environment where pressurized air sources are not usually available. Referring to FIGS. 3 and 4, a particular feature of the bed table 10 is its self-contained power source, namely a self-contained vessel 190 of pressurized working fluid. The vessel 190 is mounted in a supporting framework 191 which in turn is supported either directly or indirectly by the vehicular base framework. In the preferred embodiment illustrated in FIG. 2, for example, a floor panel 193 has been added at the lower portion of the supporting framework, and the supporting framework 191 is attached directly to the floor panel.

According to another aspect of the present invention, the preferred pressure medium used with the cylinder 168 is a compressed nitrogen gas. This particular working fluid is economical, readily available, and a fairly large quantity of the compressed fluid can be stored in a vessel of relatively modest dimensions. For example, it has been found that a sufficient quantity of compressed nitrogen suitable for over 100 complete cycles of operation of the bed table can be provided in a vessel which is approximately 8 inches in diameter and 18 inches in length. Compressed nitrogen is also preferred since it is non-injurious to a patient, to the bed table, or to surrounding equipment if the hydraulic fluid should leak from the pressure vessel 190.

A particular advantage of the fluidically operated actuating system of the preferred embodiment is its complete compatibility for use in many hazardous environments. For example, since electrical components are completely eliminated, the bed table according to the present invention can be used in he presence of oxygen, and such is a particular advantage since many patients confined to long periods of bed rest require inhalation therapy with oxygen or other materials that might present a hazardous situation. Further, since the power source for the bed table according to the present invention is completely self-contained within the bed table, any need for modification or adaption of the bed table to accommodate a different, potentially hazardous power source is eliminated. A hospital is typically staffed with a wide variety of service personnel and it is possible that some of the personnel coming in contact with the patient may not be fully trained in the potentially critical nature of the patient's situation. In addition to the presence of oxygen or the like, about a patient, there may be one or more life support systems connected to the patient. It is important that these systems not be disturbed. It is also desirable that the bed table be completely self-contained so as to reduce the risk of the patient experiencing inconvenience when attended by personnel who may not be intimately familiar with the various mechanical aspects of the bed table apparatus. The bed table constructed according to the present invention offers significant advantages in this regard. For example, the bed table can be readily used in a residential environment, for example, in which the patient's family is not expected to be trained in the intricacies of the mechanical movement and the power source of the bed table device. Also, in a residential environment, a compressed air power source is typically not available in every location where the patient might be moved. For these and other reasons a bed table according to the present invention, with its self-contained nitrogen vessel and simply operated, self-contained actuating system devoid of electrical components, provides significant advantages.

Additionally, a bed table constructed according to principles of the present invention offers significant advantages in that its actuation system uses a minimal number of moving parts, each of which can stand repetitive cleaning such as steam cleaning. For example, the only moving parts of the bed table constructed according to the present invention are the hinge plates, pins, linkage arms, and hydraulic cylinder. It is preferred that the hinge plates and pins have Teflon or the like low-friction washers or bushings at their pinned interconnection, thereby eliminating the need for oil or the like lubricant which can be flushed or diluted with steam cleaning, for example.

The bed table 10 constructed according to the present invention is provided with a number of features which enhance its usefulness in the convenient movement of a patient between a bed and the bed table device. Referring to FIGS. 1 and 6, the rearward side portions of the bed table 10 are butted against the side of a patient's be in preparation for the transfer of the patient to the bed table. FIG. 6 shows a schematic diagram of a patient's bed, including a mattress 196 and a mattress foundation 198 stacked one on top of another. The bed frame 200 supporting the mattress and mattress foundation extends to one side of the patient's bed Frequently, patients' beds are provided with a guard rail, such as the guard rail 204 of FIG. 6, which can raised and lowered as desired. For example, the guard rail can be raised to prevent a patient from rolling out of the bed, or can be lowered to facilitate the transfer of the patient to the adjustable bed table 10 or to a gurney, for example.

Referring to FIGS. 1 and 7, arm supports 206, 208 are provided at each side of the bed table at the medial support portion thereof. The arm supports 206, 208 are generally T-shaped in elevation, having vertically extending supports 210, 212, respectively. Channel supports 214, 216, having internal passageways 218, 219 extending vertically therethrough, are mounted to the side support members 72, 74 of the central frame 70. The support posts 210, 212 are received in the respective internal passageway 218, 219, being thereby mounted for vertical reciprocation.

Referring again to FIG. 6, the upper arm support 206 includes an outer depending flange 220 spaced from the support post 210 so as to form a cavity 222 therewith (see the upper portion of FIG. 6 drawn in phantom). When the bed table is butted against the patient's bed, the cavity 222 is positioned above the bed's guard rail 204. When the support arm is lowered, the guard rail is received in the recess or cavity 222, thereby locking the bed table and the frame of the patient's bed together. It is important that the bed table be securely locked to the patient's bed during a transfer between the bed and the bed table. In order to facilitate the patient's sliding onto and off of the bed table, the support arm 206 must be lowered. When configured according to the present invention, lowering of the arm support automatically provides locking engagement, as illustrated in FIG. 6. This, in conjunction with the floor brake 32, renders the bed table immovable, sufficient to prevent displacement even when a patient is slid onto the bed table 10. It is generally preferred that the arm rest 206 and padded panel 102 of the bed table be positioned at the same height as the patient's mattress 196. The other support arm 208 has a depending wall 226, similar to the depending locking flange 220 of arm 206.

As mentioned above, many patients prefer to perform as many services for themselves as is possible. Although bedridden, many patients have sufficient strength i their arms and shoulders to drag or slide their body onto the bed table. To help facilitate a patient in transferring himself onto the bed table, an overhead cantilever support 230 is provided. The overhead support 230 may, for example, be removably attached to the upper side support 72 by a mounting bracket 232. The overhead support 230 is preferably L-shaped in configuration, with the bottom free end of the vertical leg thereof received in the mounting 232. A patient could, for example, grasp the overhead horizontal leg of support 230 to pull himself by his arms onto the bed table's support surface, with the bed table in a flat, reclined position. Alternatively, the patient could slide back and forth between the bed and bed table with the bed table configured in the upright chair-like position, depending upon the patient's mobility and strength.

If desired, the overhead support 230 can easily be removed. To provide additional reinforcement for the overhead support 230, the bottom end of its vertical leg can be welded or otherwise fastened to the support frame of the bed table.

Several features of the bed table 10 for enhancing the comfort of the bed table, whether or not it incorporates a bedpan, will now be described. The bed table 10 as described above is fully operational and can be moved between its reclined table-like configuration and its erect chair-like configuration without further modification. However, as stressed above, a patient's confidence and assurance is greatly improved with an increasing sense of security that his body is at all times under control, especially when different portions of his body are displaced in different directions, as when the bed table is moved to a generally erect configuration. The greatest portion of the patient's weight is borne by the central support portion, and to an even greater extent, the head support portion, of the bed table. As the patient's upper torso is raised toward a vertical position, the force of gravity imparts an ever increasing contacting force with the central support portion of the bed table and such is favorable to increasing a patient's sense of security.

However, depending upon the patient's clothing and the fabric covering the padded panels of the bed table, a patient might fee insecure if contact with the central support portion 16 is attended by a low coefficient of friction. That is, the patient might sense the tendency of his body to slip off the bed table in a downward direction. With regard to the patient's sense of security, it is irrelevant whether the sensation of slipping is accurately perceived or not. Accordingly, it is important that the patient be provided with a footrest, such as the footrest 270, which is adjustable for patients of different body height. The footrest 270 includes a support platform 272 having lateral ends 274, 276. Lateral extension arms 278, 280 extend from the lateral edges 274, 276 and over the outside side surface 108*a* of the side support member 108 of framework 106. Arms 281 extend toward the free end of leg support portion 18 and have lugs or pawls 282 at their free ends.

Figure 14:
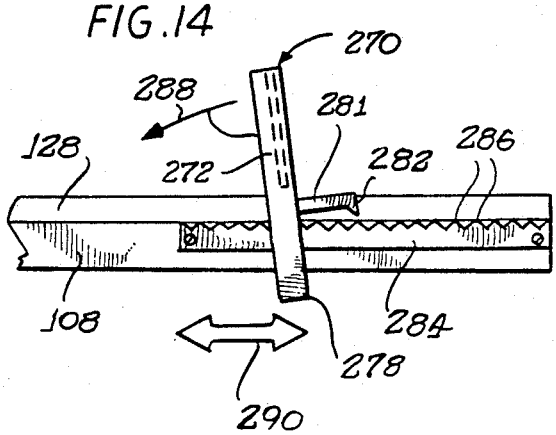
FIG. 14 shows the foot support being moved from one position to another.

Racks 284 are mounted to the outside surface 108*a* of support member 108 and are also mounted to the outside surface of the opposite support member 110. The racks 284 have upwardly extending teeth 286. The foot support 270 may be pivoted in the direction of arrow 288 (See FIG. 14) so as to disengage the foot support from the rack 284, freeing the foot support for movement back and forth in the direction of arrow 290. When disengaged, as illustrated in FIG. 14, the foot support can be adjusted to accommodate patients of different body height. When a desired position of the footrest is obtained, the footrest 270 is rotated in the direction of arrow 292 so as to bring pawl 282 in engagement with rack 284 between a pair of adjacent teeth 286. In order to prevent accidental disengagement from the leg support portion 18, the foot support 270 is provided with inwardly extending or stop members 294 located at the bottom free ends of lateral extension arms 278, 280.

If, when released, the foot support is rotated an unusual amount in the direction of arrow 288 (see FIG. 14), stop members 294 engage the bottom surface 108*b* of support member 108, thus preventing an unintentional disengagement from leg support portion 18. If desired, however, the foot support 270 when released from rack 284, can be moved toward the free end of the leg support portion 18 ad disengaged therefrom. Other arrangements may be used for providing an adjustably relocatable foot support. For example, the gap or spacing 296 between the stop 294 and the underside surface 108*b* of support member 108 can be reduced to a minimal amount, and a locating peg can be inserted through lateral extension arms 278, 280 to provide an immovably fixed location for the foot support 270. Other arrangements are possible such as contemplated by the present invention.

According to other aspects of the present invention, the adjustable bed table 10 is particularly suitable for providing bedpan or commode facilities for a bedridden patient. As described above, the number of features of the bed table 10 greatly enhance the ease with which a patient may be moved from the bed onto the table, or may easily move himself if capable of doing so. As mentioned briefly above, it has been found that many patients prefer to take care of themselves as much as possible, even if the exertion is laborious and somewhat difficult. The several locking features of the bed table, the overhead pull bar or support bar 230, and the stable construction of the vehicular base support all enhance the ability of the patient to transfer himself between a bed and the be table.

Further, as has been seen above, the bed table according the principles of the present invention is capable of fully automatic operation under control of the patient. Several features described above contribute greatly to the sense of security and enhance the patient's confidence in attempting fully automatic operation of the bed table even when unattended. The actuator system, as described above, offers a continuously smooth, controlled raising and lowering of the head support portion throughout the entire range of its motion. With the use of an internal spring within the cylinder or with the use of a double-acting cylinder, for example, the precision of the movement of the head support portion is greatly increased, that is, made highly repeatable from one cycle of operation to another. Further, the patient may be provided with convenient controls for limiting the rate of movement of the table, if desired. As a further factor inducing a patient to exercise as much self-help as possible, operation of the bed table is made completely safe even in hazardous environments as where oxygen is used, for example. Also, even if the power supply, herein a self-contained compressed nitrogen tank, is exhausted or otherwise interrupted, the patient, due to stored energy in the actuator system is able to lower himself to a reclining position in the same smooth, controlled operation as is experienced during normal operation. These and other features contribute greatly to the ability of a patient to care for himself and, in part, make the bed table 10 particularly useful as a bedpan or commode suitable for unassisted operation.

Referring to FIGS. 3 and 10–12, a bedpan 250 includes a bowl portion 252 having a side wall 254, and an outwardly extending rim 256 at the outer periphery of its upper end. If desired, the side wall 254 can be provided with graduated markings indicating the volume content of the bowl portion of the bedpan. Bedpan 250 may be formed from any convenient material but is preferably of a disposable type made from a thermoformed plastic. As will be seen in greater detail, the bedpan 250 is mounted to the underside of central support section 16, being pressed against the underside of padded panel 102.

Figure 11:
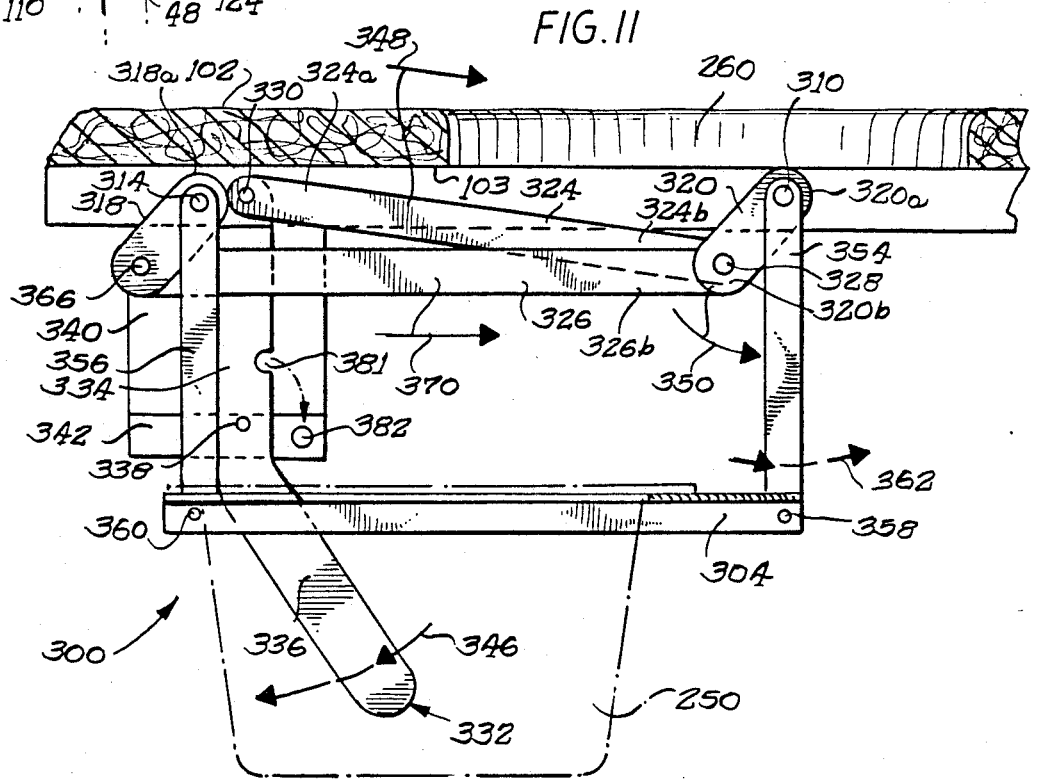
FIG. 11 is a side elevational view of the bedpan mounting apparatus of FIG. 10.
Figure 12:
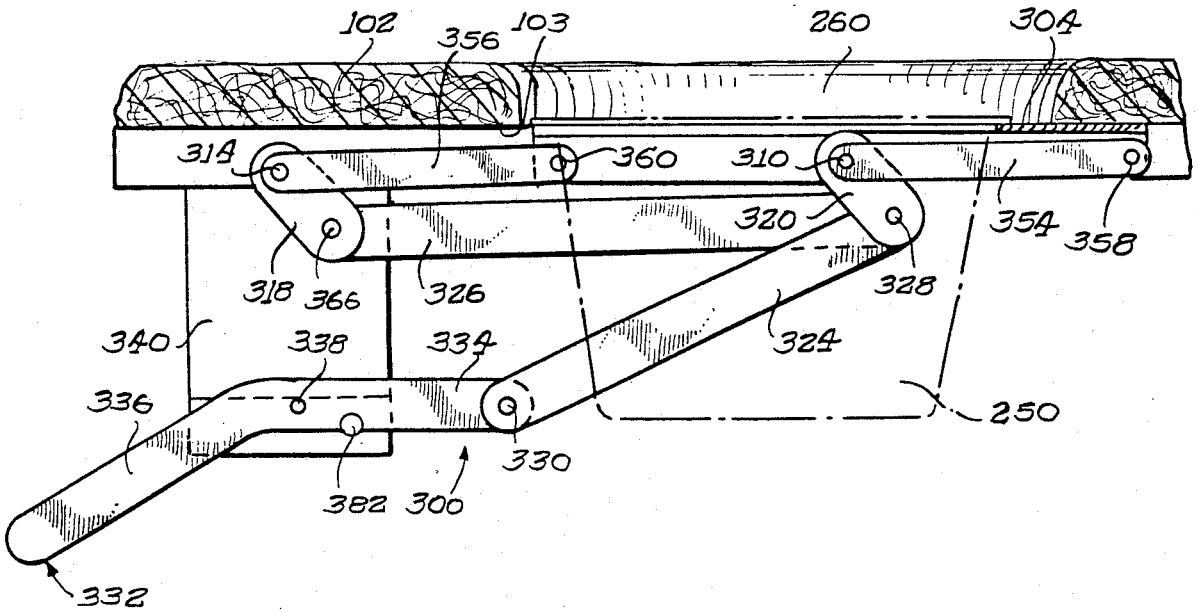
FIG. 12 is a side elevational view similar to that of FIG. 11, but showing the bedpan in a raised, operative position.

Referring to FIGS. 1 and 2, the padded panel 102 is provided with a central aperture 260 extending through the thickness of padded panel 102 so as to form a continuous opening between the upper and lower major surfaces thereof. Referring briefly to FIGS. 11 and 12, the bedpan 250 is moved between a lower position (See FIG. 11) for loading and unloading of the bedpan, and an upper operative position (See FIG. 12).

Referring now to FIGS. 10–12, the mechanism for raising and lowering the bedpan 90 is generally indicated at 3000. Mechanism 100 is suspended from the central support section 14 of bed table 10. The mechanism includes a support tray 304 having a U-shaped cutout or bedpan-receiving aperture 306. The rim 256 of bedpan 250 overlies the U-shaped periphery of aperture 306, as indicated in FIGS. 11 and 12. As will be seen, bedpan 250 is maintained in its generally upright position with rim 256 generally horizontally oriented throughout the entire range of motion of mechanism 300. Support tray 304 is suspended from the midsection 14 of the bed table through a series of linkages. The linkages include stub shafts 310, 312 rotatably mounted to the transverse rib members 76, 62 of framework 24. A continuous shaft 314 having ends **314*a*, 314*b*, extends between the lateral rib members 76, 62. The ends 314*a*, 314*b* of shaft 314 are free to pivot or turn, as are the stub shafts 310, 312. Relatively short forward and rearward connector links or lever arms 318, 320, have first ends 318*a*, 320*a*, which are fixedly connected to shafts 314, 310, respectively. Thus, no angular displacement is permitted between lever arm 318 and shaft 314 or between lever arm 320 and shaft 310. The bottom end 320*b* of lever arm 320 is pinned to a crank arm 324 and an intermediate arm 326 by a pin 328. The ends 324*b*, 326*b* joined to upper arm 320 by pin 328 are free to rotate thereabout, as mechanism 300 traverses its range of motion. The opposed end 324*a* of crank arm 324 is rotatably pinned at 330 to one end of a crank handle 332. The crank handle 332 preferably has a dogleg shape with a first leg 334 and a second, manually graspable leg 336. Crank handle 332 is pinned at 338 to a bracket 340 (See FIG. 10) suspended at its upper end from transverse rib 76. As can be seen in FIG. 10, bracket 340 is generally Z-shaped in cross-section, having an inwardly offset lower end 342 where pi 338 is attached. When the manually graspable end 336 of crank handle 332 is rotatably advanced in the direction of arrow 346 (see FIG. 11) leg 334 pivots in a clockwise direction about pin 338, such that crank arm 324 is initially advanced in a generally axial direction indicated by arrow 348. As the remote end 324*b* of crank arm 324 is advanced by deflection of the crank handle, the arm is pivoted about pin 328, thereby advancing lever arm 320 and stub shaft 310 in the clockwise direction of arrow 350. Upright linkage or hanger arms 354, 356 have upper arms fixedly connected to stub shaft 310 and shaft 314, respectively. The lower ends of hanger arms 354, 356 are pivotably connected at 358, 360 to the rearward and forward ends of support tray 304. Thus, as the lever arm 320 and stub shaft 310 are advanced in the counterclockwise direction of arrow 350, the hanger arm 354 fixedly attached at its upper end to stub shaft 310 is also displaced in the counterclockwise direction of arrow 362, as shown in FIG. 11**.

Intermediate arm 326, as mentioned above, is pinned at one end by pin 328 to lever arm 320. The opposed end of arm 326 is pinned at 366 to the forward lever arm 318. Thus, initial displacement of crank handle 332, by displacing the rearward lever arm 320, causes a generally axial displacement of arm 326 in the direction of arrow 370. This in turn causes the lever arm 318 to follow the pin connection 366 which is made to arm 326. Since the upper end **318*a* of arm 318 is fixedly connected to the end 314*b* of shaft 314, and since the upper end of hanger arm 356 is also fixedly connected to shaft 314, the hanger arm 356 responds to displacement of crank handle 332 by following in a counterclockwise direction. Since the forward and rearward ends of support tray 304** are equally displaced at uniform rates, the support tray is maintained at all times in a horizontal attitude.

Referring again to FIG. 10, shaft 314 is made to rotate about its axis as crank handle 332 is displaced by pulling in an outward direction. As mentioned above, the end **314*a* of shaft 314 is mounted for rotation in transverse rib 62. A third hanger arm 374 has an upper end fixedly attached to shaft 314 so as to follow the angular displacement thereof. The lower end of hanger arm 374 is pinned through the other lateral edge of tray support 304, at the forward end thereof, by a pin 376. The remaining corner of support tray 304 is hangingly and pivotally connected to stub shaft 312 by a fourth hanger arm 378 pivotally connected at its lower end by pin 380** to the rearward end of the support tray.

The upper end of hanger arm 378 is connected to stub shaft 312 so that it can rotate about the axis of that stub shaft. The upper end of hanger arm 378 can be fixedly secured to stub shaft 312 if the stub shaft is rotatably mounted to transverse rib 62. Alternatively, the stub shaft 312 can be fixedly connected to the transverse rib 62 and the upper end of hanger arm 378 pivotally connected to the free end of the stub shaft. The remaining corner of support tray 304, that corner supported by hanger arm 378, has raising and lowering forces transmitted thereto through the lateral side portions 305, 307 (see FIG. 10) of the rigid tray support 304. Although a raising and lowering force is not applied directly to the upper end of hanger arm 378, as in the remaining three hanger arms, a raising and lowering force is applied to the remaining corner of support tray 304 through two independent orthogonal paths, adjacent the two edges 305, 307, which meet at a corner of the rectangular tray support. Thus, all four corners of the tray support 304 are positively driven during both raising and lowering motions, and although linkages in the mechanism 300 may be described as including a follower linkage arrangement, a raising and lowering force is, in a very significant sense, independently transmitted to each corner of the tray support through separate paths.

Referring to FIGS. 10–12, operation of mechanism 300 will now be described. Initially, it is assumed that the tray support 304 is in a downward and forward displacement, as indicated in FIGS. 10 and 11. With outward displacement of crank handle 332 at its manually graspable end 336, the crank handle rotates about pin 338 in a clockwise direction, displacing the upper end of the crank handle and the pin connection 330 thereat in a rightward direction. This, in turn, causes an initially axial displacement of crank arm 324 in the direction of arrow 348. The remote end of crank arm 324 pivotally pinned at 328 to lever arm 320, causes clockwise rotation of the lever arm in the direction of arrow 350.

Since the upper end 320*a* of lever arm 320 is fixedly connected to stub shaft 310, the stub shaft is made to rotate in a clockwise direction, thereby displacing hanger arm 354 in a counterclockwise direction. The upper end of that hanger arm is also fixedly connected to the same stub shaft 310. This in turn causes the rearward left-hand corner 309 of tray support 304 (when viewed from the front of table 10) to swing in a generally rearward and upward direction, that is, a clockwise direction as illustrated in FIG. 11.

This swinging displacement is transmitted by the support tray to the forward end of that tray whereat a second hanger arm 356 is pinned by pin 360. In response thereto, hanger arm 356 is displaced in a clockwise direction. Since the upper end of hanger arm 356 is fixedly secured to one end of shaft 314, the shaft is made to rotate about its axis, in response to the swinging displacement of the lower end of hanger arm 356. The forward lever arm 318 is also fixedly secured at its upper end to shaft 314, and in response to the swinging displacement of hanger arm 356, is displaced in a clockwise direction. Concurrently therewith, a second arm 326 which has its rearward end pinned at 328 to the rearward end of arm 324, is displaced in the direction of arrow 370. The forward end of arm 326 is pivotally connected at 366 t the lever arm 318, thereby assisting in the clockwise displacement thereof. Thus, it can be seen that swinging power is simultaneously applied to both the forward and rearward ends of the left-hand edge of support tray 304.

Shaft 314, as mentioned above, is pivotally mounted at its ends 314*a*, 314*b*. The displacement of crank handle 332, as described above, causes rotation of shaft 314 about its axis. Referring to the upper left-hand portion of FIG. 10, a third hanger arm 374 fixedly connected to end 314*a* of shaft 314 is displaced in a manner similar to that of its mating hanger arm 356. The lower end of the third hanger arm 374 is pinned at 376 to the forward right-hand corner of support tray 304. The swinging force of hanger arm 374 is transmitted through the support tray to the remaining rearward right-hand corner thereof, which is pivotally mounted at 380 to the lower end of a fourth hanger arm 378. The hanger arm 378 is mounted to stub shaft 312 for rotation about tee axis of that stub shaft. Thus, it can be seen that swinging displacement occurs simultaneously and in equal amounts and rates at each of the four corners of the support tray 304. The mechanism 300 provides an exceptionally smooth displacement of the tray support and the bedpan mounted therein throughout the entire range of motion of the mechanism, and has been found to provide a significant mechanical advantage easily operable by users having reduced manual strength and dexterity.

The clockwise deflection of crank handle 332 continues until, as illustrated in FIG. 12, a notch 380 is engaged with a stop pin 382 fixedly secured to the bottom end 342 of bracket 340. As visually indicated in FIG. 12, arm 324 and leg 334 of crank handle 332 comprise a toggle arrangement which passes through an over-center position just before the time the notched leg 334 of the crank handle engages stop pin 382. As can be seen by comparison of FIGS. 11 and 12, the bedpan 250 is displaced by mechanism 300 in rearward and upward directions, being locked in registry with the opening 260 in center support section 16, with the rim 256 of the bedpan 250 locked in engagement with the underneath surface 103 of padded panel 102.

With reference to FIG. 10, it can be seen that mechanism 300 is optimally compact, requiring an area in plan view just slightly larger than that of the bedpan 250. Further, although the bedpan is mounted for swinging in a generally forward direction as the bedpan is lowered, significant portions of the mechanism 300 are not required to project forward of the lowered bedpan position. Thus, the front side of table 10 is relatively clean and unobstructed, presenting an aesthetically pleasing appearance and providing a corridor on the forward and rearward sides of the mechanism 300 suitable for locating any control line wires for monitoring equipment or the like that may be required.

Further, the mechanism 300 provides a swingable mounting for the bedpan which maintains the bedpan in a horizontal position throughout its range of motion, which provides control over each corner of a tray supporting the bedpan and which swings the bedpan forwardly.

Operation of the bed table will now be described. The bed table 10 is conveniently provided with a vehicular mounting and may be moved from one patient's room to another, for example. Upon entry into a patient's room, the bed table 10 is reclined to the table-like configuration illustrated in FIGS. 1 and 3, and the arm rest adjacent the patient's bed is elevated. The bed table is then positioned so that one of its longer sides is butted up next to a side of the patient's bed. Next, the bed is fixed in position by operating foot pedal 38 so as to engage the floor stop 32 with the floor of the patient's room. The arm rest adjacent the patient's bed (herein arm rest 20) is lowered so that the depending wall 220 thereof engages a bed rail 204 of the patient's bed, as illustrated in FIG. 6. Thus, the bed table is firmly secured in position and is able to withstand dislocating forces applied thereto as when a patient is dragged sideways onto the bed table. If a patient is able, he may move his body sideways onto the upper surface of the bed table with his head, midsection, and legs supported by the head support, central support, and leg support sections 14, 18 of the bed table.

Figure 13:
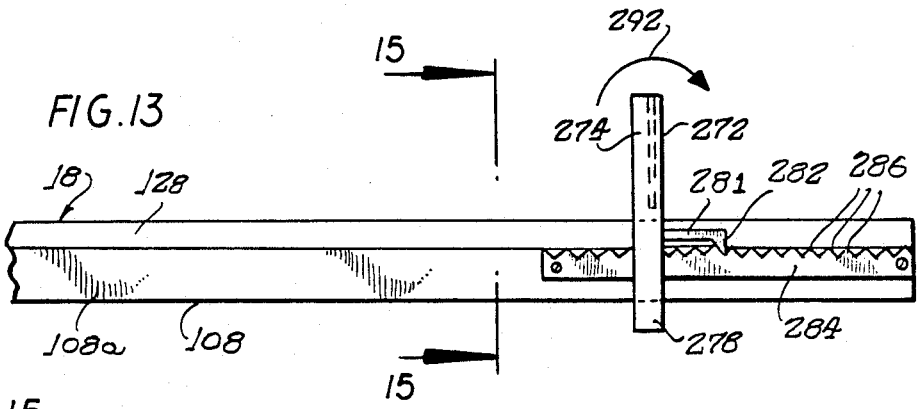
FIG. 13 is a fragmentary side elevational view of the adjustable bed table of FIG. 3 showing the foot support portion in greater detail.

The patient may use the overhead support bar 230 for assistance in moving on to the bed table. If readjustment of the foot support 270 is required, an assistant or the patient can perform the operation as described above with regard to FIGS. 13 and 14. The patient will then adjust his position on the bed table so that his feet contact the platform 272.

Next, an attendant, if present, depresses the "up" button 186 of control panel 180 or of control panel 184 if that latter control panel is provided. Alternatively, if the patient desires to operate the bed table himself, a control panel 184 is provided adjacent the patient's right hand and the patient can then depress the push button 186. This causes a discharge of pressurized working medium (such as the pressurized nitrogen gas) stored in vessel 190 to enter the bottom portion of hydraulic cylinder 168, thereby causing the piston therewithin to be displaced toward the upper end of the cylinder housing 170. If an internal return spring is provided within housing 170, the spring is automatically compressed as the piston is displaced toward the upper end of the housing. This in turn causes a piston rod 176 affixed to the piston to start its extension.

As piston rod 176 is extended, the triangular relationship formed between the cylinder and the head support portion changes. This triangular relationship may be observed with reference to FIG. 4 wherein a first side of the triangle comprises the cylinder 168, including its piston rod 176. The first side of the triangle extends between the pivot connections 162, 172, respectively. The second side of the triangle is observed as extending between the pivot connection 162 and the hinge plate 80 of the head support portion. It is noted in this regard that the pivot connection 162 is located along the longitudinal center line of the bed table being located midway between the support members 86, 88 of carrier 84 (see FIG. 7). The remaining side of the triangle is formed between the hinge plate 80 and pivot connection 172. As the piston rod is extended, the angle formed between the cylinder and the head support portion is decreased, as is the angle between the hydraulic cylinder and an imaginary line extending between the hinge plate 80 and pivot connection 172. The change in the triangular configuration is, in terms of the mechanical operation of the bed table, resolved in a moment or torque about the hinge plates 80, 82 of the head support portion. The elevation of the head support portion 14 continues, with the piston rod 176 continuing past a true vertical position by a slight amount, so as to form a sharply acute angle a with the vertical, as indicated in FIG. 4.

As the head support portion is elevated in the direction of arrow 400, the hinge plates 136, 138 attached to the head support portion are rotated in the direction of arrow 404 (See FIG. 8). This results in a longitudinal displacement of linkage arm 146 in the direction of arrow 406. This in turn causes a clockwise displacement of hinge plate 142, thereby resulting in a pivoting of the leg support portion 18 about its hinge members 120, 122. During raising of the head support portion and lowering of the leg support portion, the patient's weight is shifted by gravity against the central support portion 16 and the foot support platform 272. If desired, the patient can grasp the arm rests 206, 208 to stabilize his upper torso without rocking or leaning in a lateral direction.

As mentioned above, it is preferred the actuator system be configured such that energy is stored in the hydraulic cylinder such that, even if the power source is unavailable for the return portion of the operations cycle, there is sufficient energy in the system for the controlled lowering of he head support portion of the bed table. According to one aspect of the present invention, the amount of energy stored in the actuator system upon return of the bed table to the reclining position is large enough so that the shifting of the downward loading on the head support portion to the patient shifting his weight is negligible or at least small compared to the energy stored in the actuator system. In this manner, the patient's sense of security is maintained during automatic operation of the bed table, even during an outage of the power source. With the improved reliability of performance of the bed table patients are more inclined to use the bed table apparatus without assistance.

When a patient desires to reconfigure the bed table to a reclining position, the patient or an attendant can depress one of the "down" buttons 188 located on either control panel 180 or 184. This initiates a controlled release of hydraulic pressure within the cylinder 168 allowing the piston to return to its retracted position, thereby lowering the head support portion. When the cylinder is operated in a single action mode with an internal return spring, the fluid pressure internal to the cylinder is augumented by the spring force in the manner described above. For example, pressure may be relieved from the bottom of the cylinder through one of the illustrated fluid lines between the bottom of the cylinder and the control panel 180. If a double-acting mode of operation is utilized, fluid pressure is applied to the upper end of the cylinder housing to drive the piston in a downward direction toward a pivot coupling 172.

As mentioned above, the head support and leg support portions are connected together by the linkage illustrated in FIGS. 7–9. In general, the leg support portion 18 follows the movement of the head support portion 14. As the head support portion is raised, for example, a torque is applied to the hinge plate 142 fixedly secured by welding or the like to the framework 106 of the leg support portion. Due to the rigid interconnection between the head support and leg support portions, the leg support portion follows the movement of the head support portion in a reliable, reputable manner. As mentioned above, it is preferred that the head support and leg support portions are aligned coplanar with the central support portion 16 while the bed table is in a reclined position.

One advantage of the actuator system which includes the linkage connection between head support and leg support portions illustrated in FIGS. 7–9, is that a "corridor" or passageway for fluid-containing cables and the like is maintained throughout the central support portion, as well as the head support and leg support portions.

If desired, passageways within the hollow frame members may be used to route hydraulic lines and the like. For example, the passageway 73 in the side support member 72 (See FIG. 5) and the internal passageway 75 in the support member 74 (See FIG. 6) can be used for this purpose.

As a further advantage, the linkage interconnecting the head support and leg support portions as well as the remainder of the actuator system is comprised of a relatively small number of parts. The linkage system as can be seen in FIGS. 7–9, is advantageously maintained in a safe location free from unintentional contact with the patient or an attendant. As mentioned above, and as illustrated in FIG. 1, wall panel portions can be and preferably are applied to the open framework of the vehicular support base to provide a further measure of safety in this regard. In addition to wall panels, there are a number of spaces available within the open framework for mounting auxiliary equipment such as sliding drawers 420 as shown in FIGS. 2–4. The drawer is conveniently mounted on runners 422, 424 attached to the underside of a shelf 428 suspended between upright supports 40, 42.

It will thus be seen the objects herein set forth may readily and efficiently be obtained, since certain changes may be made in the above construction, and different embodiments of the invention can be made without departing from the scope thereof. It is intended that all matter contained in the above description, or shown in the accompanying drawings shall be interpreted as illustrative and not in a limiting sense.

What is claimed is:

1. A vehicular mounted bed table apparatus for adjustably supporting a person in a number of different postures, comprising:

a segmented table top having a head support portion for supporting the person's head, a double ended medial support portion for supporting the person's mid-section, and a leg support portion for supporting the person's legs;

a vehicular frame for supporting the table top;

means for mounting at least said medial support portion to said vehicular frame;

means for pivotably connecting said head support portion to one end of said medial support portion;

means for pivotably connecting the leg support portion to the other end of said medial portion;

pressure-responsive fluidically operated displacement means connected to said head support portion for pivotable displacement of said head portion with respect to said medial support portion to thereby raise and lower the upper portion of a person reclining on said bed table;

pressure means for imparting fluidic pressure to said fluidically operated displacement means, and a bedpan mounted to said medial support portion, including means for raising and lowering said bedpan with respect to said medial support portion, wherein said means for raising and lowering said bedpan comprises means mounted to said medial support portion for pivotably swinging said bedpan into and out of engagement with said medial support portion.

2. The apparatus of claim 1 further comprising means connecting said head and leg support portions so as to pivotably displace said leg support portion with respect to said medial support portion in response to the pivotable displacement of said head support portion.

3. The apparatus of claim 2 wherein said connecting means comprises a double-ended linkage means pivotably connected at first and second ends to said head and said leg support portions, respectively.

4. The apparatus of claim 1 wherein said fluidically operated displacement means comprises a cylinder having a mounting end and a piston rod extendable and retractable out of and into said cylinder, said mounting end mounted to said vehicular frame, and means for pivotably mounting said piston rod to said head support portion, said cylinder responsive to said pressure means to extend and retract said piston rod so as to raise and lower said head portion, respectively.

5. The apparatus of claim 4 further comprising linkage means interconnecting said head and said leg support portions so that said leg support portion is lowered as said head portion is raised, and so that said leg support portion is raised as said head portion is lowered.

6. The apparatus of claim 1 wherein said pivotable mounting means comprises at least one pivotally interconnected pair of parallel linkage members on either side of said bedpan.

7. The apparatus of claim 6 wherein said pivotable mounting means includes a support tray with at least three spaced-apart points spaced about said mounting means, each support point pivotably swung by said linkage members.

8. The apparatus of claim 6 wherein said pivotally interconnected pair of parallel linkage members comprises a first generally horizontal linkage member adjacent the bedpan and a second, generally horizontal linkage member adjacent the bed table, first and second interconnecting hanger members pivotally connected at first ends to one linkage member and pivotally connected at the other ends to the other linkage member through relatively short connector links.

9. The apparatus of claim 8 further comprising a double-ended crank handle pivotally mounted to the vehicular frame at a medial portion, and having a pivotal connection at one end, and further comprising a third linkage member pivotally connected at one end to the crank handle and pivotally connected at the other end to one said connector link.

10. The apparatus of claim 1 further comprising arm support means mounted to at least one of said medial support portion and said vehicular frame; and means for mounting said arm support for movement between raised and lowered positions.

11. The apparatus of claim 1 further comprising a locking flange depending from said arm support and movable therewith between raised and lowered positions, the locking flange being engageable with a patient's bed frame so as to lock the bed table apparatus to the bed frame to prevent relative movement therebetween as the patient is transferred therebetween.

12. The apparatus of claim 1 further comprising a generally L-shaped overhead support having a first leg with a free end mounted to the vehicular frame and a second leg extending over the bed table with a free end positioned adjacent one side of the bed table.

13. The apparatus of claim 1 further comprising an adjustably movable footrest located at a free end of the leg support portion, the footrest being removably engageable with the lateral sides of the leg support portion so as to be selectively positionable toward and away from the medial support to accommodate patients of different body height.

14. The apparatus of claim 13 further comprising toothed racks at each lateral side of the leg support portion, the foot support further comprising arms having free ends, and pawls located at the free ends engageable with teeth of the racks for securement therebetween, when pivoted theretoward.

15. The apparatus of claim 14 wherein said means for raising and lowering said bedpan comprises a bedpan-supporting table having rectangular configuration with four corners, hanger arms having lower ends pinned to each corner of the support table, an elongated shaft extending between one pair of hanger arms and fixably attached thereto, a first stub shaft rotatably attached to the third hanger arm, a second stub shaft having first and second ends with the first end fixedly pinned to the remaining hanger arm, a first connector link having a second end and a first end fixedly attached to the second end of said second stub shaft, a second connector link having a first end fixedly attached to said elongated shaft and a second end, and an intermediate link having two ends pivotally connected to the second ends of said first and said second connector links, so that a force applied to the intermediate linkage arm is transmitted to three of the four corners of said table through said hanger arms and is further transmitted to the remaining corner of said support table through two separate portions of said support table.

16. The apparatus of claim 15 further comprising a crank arm having one end pivotally connected to the pivotal connection of said intermediate link arm and said one connector link, and a pivotally mounted crank handle having a first manually graspable end and a second end pivotally connected to a second end of said crank arm.

17. A vehicular mounted bed table apparatus having bedpan facilities, comprising:

a segmented table top for adjustably supporting a person in a number of different postures, including a head support portion for supporting the person's head, a double-ended medial support portion for supporting the person's midsection, and a leg support portion for supporting the person's legs;

a bedpan mounted to said medial support portion;

means for raising and lowering said bedpan including means mounted to said medial support portion for pivotally swinging, said bedpan into and out of engagement with said medial support portion;

a vehicular frame for supporting the table top and the bedpan;

means for mounting at least said medial portion to said vehicular frame;

means for pivotally connecting said head support portion to one end of said medial support portion;

means for pivotably connecting the leg support portion to the other end of said medial support portion;

pressure-responsive fluidically operated displacement means connected to said head support portion for pivotably displacing said head support portion with respect to said medial support portion so as to raise and lower the upper portion of a person reclining on said table top; and pressure means for imparting fluidic pressure to said fluidically operated displacement means.

18. A vehicular-mounted bed table having a bedpan apparatus swingably mounted thereto for installation and removal therefrom, comprising:

a segmented table top having a head support portion for supporting a person's head, a double-ended medial support portion for supporting the person's midsection, and a leg support portion for supporting the person's legs;

a bedpan swingably mounted to said medial support portion;

means for raising and lowering said bedpan comprising pivotable mounting means secured to said medial support section pivotally interconnected to at least three spaced-apart support points spaced about the outer periphery of the bedpan;

a vehicular frame for supporting the table top;

means for mounting at least said medial support portion to said vehicular frame;

means for pivotably connecting said head support portion to one end of said medial support portion;

means for pivotably connecting a leg support portion to the other end of said medial support portion; and pressure-responsive fluidically operated displacement means connected to said head support portion for pivotable displacement of said head support portion with respect to said medial support portion to raise and lower the upper portion of a person reclining on said table top.

* * * * *